United States Patent [19]

Visceglia et al.

[11] 3,992,003

[45] Nov. 16, 1976

[54] AEROSOL CONTAINER HAVING SEALED PROPELLANT MEANS

[76] Inventors: Marco P. Visceglia, 6118 Liebig Ave., Bronx, N.Y. 10471; Trevor Wisdom, 41 University Place, Glen Head, N.Y. 11545

[22] Filed: Oct. 24, 1975

[21] Appl. No.: 625,684

[52] U.S. Cl. ..... 272/94; 222/386.5

[51] Int. Cl.[2] ..... B65D 35/28

[58] Field of Search ..... 222/92, 94, 105, 136, 222/145, 386.5, 402.18, 482–484

[56] References Cited

UNITED STATES PATENTS

| | | | |
|---|---|---|---|
| 2,723,161 | 11/1955 | Covington | 222/386.5 |
| 3,245,435 | 4/1966 | Healy | 222/386.5 X |
| 3,260,421 | 7/1966 | Rabussier | 222/394 |
| 3,342,377 | 9/1967 | Peredy | 222/386.5 |
| 3,416,709 | 12/1968 | Shultz et al. | 222/94 |
| 3,608,781 | 9/1971 | Flynn | 222/94 |
| 3,608,782 | 9/1971 | Sathicq | 222/94 |
| 3,659,395 | 5/1972 | Morane et al. | 222/386.5 |
| 3,662,929 | 5/1972 | Sims | 222/386.5 |
| 3,718,236 | 2/1973 | Reyner et al. | 222/386.5 |
| 3,799,398 | 3/1974 | Mordne et al. | 222/39 |

FOREIGN PATENTS OR APPLICATIONS

| | | | |
|---|---|---|---|
| 1,418,581 | 10/1965 | France | 222/94 |

*Primary Examiner*—Allen N. Knowles
*Assistant Examiner*—William L. Stack, Jr.
*Attorney, Agent, or Firm*—Richard A. Joel

[57] ABSTRACT

An aerosol container having sealed propellant means comprises a flexible propellant bag having air or inert gases under pressure and a predetermined quantity of product located within the container. In a first embodiment, the propellant bag is fixedly mounted at the outlet and includes a separate valve for loading of the pressurized gas. A second valve is mounted at the outlet and is connected to a perforated tube which extends downwardly into the container to emit product when the valve stem is depressed. Actuation of the valve stem causes the propellant bag to expand forcing the product out through the valve. In a second embodiment, the container includes a plurality of product bags which are mounted to a valve arrangement at the outlet and a pressurized propellant which is forced into the container to maintain the product bags under pressure. The valve arrangement comprises a separate valve for each product bag and a valve for loading the propellant into the container tube. The product valves are connected to a mixing cap to emit a predetermined spray when the cap is depressed. In both embodiments of the invention, the propellant is not emitted with the spray and in instances where fluorocarbons are used this is an important ecological advantage.

9 Claims, 4 Drawing Figures

AEROSOL CONTAINER HAVING SEALED PROPELLANT MEANS

BACKGROUND OF THE INVENTION

This invention relates to an aerosol container and particularly to an aerosol container having a sealed propellant means.

The prior art discloses various aerosol containers having sealed propellant bags and the use of perforated pick up tubes as well as the use of air as a propellant. Specifically, U.S. Pat. No. 3,099,370 to Hein discloses a dispensing container wherein the product and propellant are maintained separately by placing a gas-tight but movable barrier between the product and propellant. Further U.S. Pat. No. 3,178,075 to Riedl discloses a pressurized container which includes a self-inflating but flexible bag having a carbon dioxide generator positioned within the bag and a perforated pick up tube located along the side of the container to prevent the product from being trapped as the bag expands.

Further prior art of interest include U.S. Pat. No. 3,300,102 to Budzich, U.S. Pat. No. 3,317,090 to Meshberg, both of which disclose aerosol containers with inflatable bags positioned therein. Mueller U.S. Pat. No. 3,319,837 discloses a two zone dispenser having an outer wall that is both flexible and resilient while U.S. Pat. No. 3,415,425 to Knight et al discloses an aerosol dispenser which employs a flexible bag-like diaphragm for separating the product into two chambers.

In contrast to the prior art disclosed above, which is in general representative but not all-inclusive of the pertinent prior art, the present invention discloses a unique aerosol container arrangement. The container includes a sealed propellant means in one embodiment having separate valve means for the product and for the propellant with a perforated tube extending downwardly into the product and for the propellant with a perforated tube extending downwardly into the product area to permit exiting of the product under pressure. In a second embodiment, the product is included in one or more inflatable bags with the propellant surrounding said bags to force the product from the various bags under pressure when a mixing cap is depressed. Thus, it is possible to emit a spray of a predetermined mixture from a single aerosol container. An important advantage of both embodiments is that the propellant is not emitted with the product and the container is particularly suited for the use of compressed air or inert gas as a propellant.

SUMMARY OF THE INVENTION

The present invention pertains to an improved aerosol container and particularly to a container having one or more sealed bags positioned therein. In one embodiment, the propellant is located in a flexible bag within the container to force the product through a dip tube having a plurality of apertures therein upon actuation of the aerosol container. Separate valve means are provided for the propellant and product. The propellant may be air or an inert gas under pressure so that there is no question of pollution or contamination of the ozone layer of the atmosphere or it may be a fluorocarbon gas which may disposed of with the empty product container.

In a second embodiment, the aerosol container comprises one or more sealed bags mounted to separate valve means at the aperture of the container and a propellant means which is forced into the container through separate valve means under pressure. The product from the sealed product bags is emitted in predetermined portions when a valve cap is depressed permitting the product to exit from separate valves through passages of a predetermined size. The various passages come together in a single outlet passage to provide a particular spray mixture. Advantageously, a single container may, therefore, be employed to provide a spray mixture which is particularly useful in cases where it is impossible or difficult to mix the materials prior to use.

Accordingly, an object of this invention is to provide a new and improved aerosol container.

Another object of this invention is to provide a new and improved aerosol container having sealed propellant means mounted therein to prevent contamination of the atmosphere.

A further object of this invention is to provide a new and improved aerosol container having means for mixing one or more products together in a spray which may be emitted therefrom.

A still further object of this invention is to provide a new and improved aerosol container having sealed propellant means that can be used effectively up-side down.

BRIEF DESCRIPTION OF THE DRAWINGS

Other objects and advantages of this invention may be seen from the following description when viewed in conjunction with the accompanying drawings wherein.

DETAILED DESCRIPTION OF THE INVENTION

Figure 1:
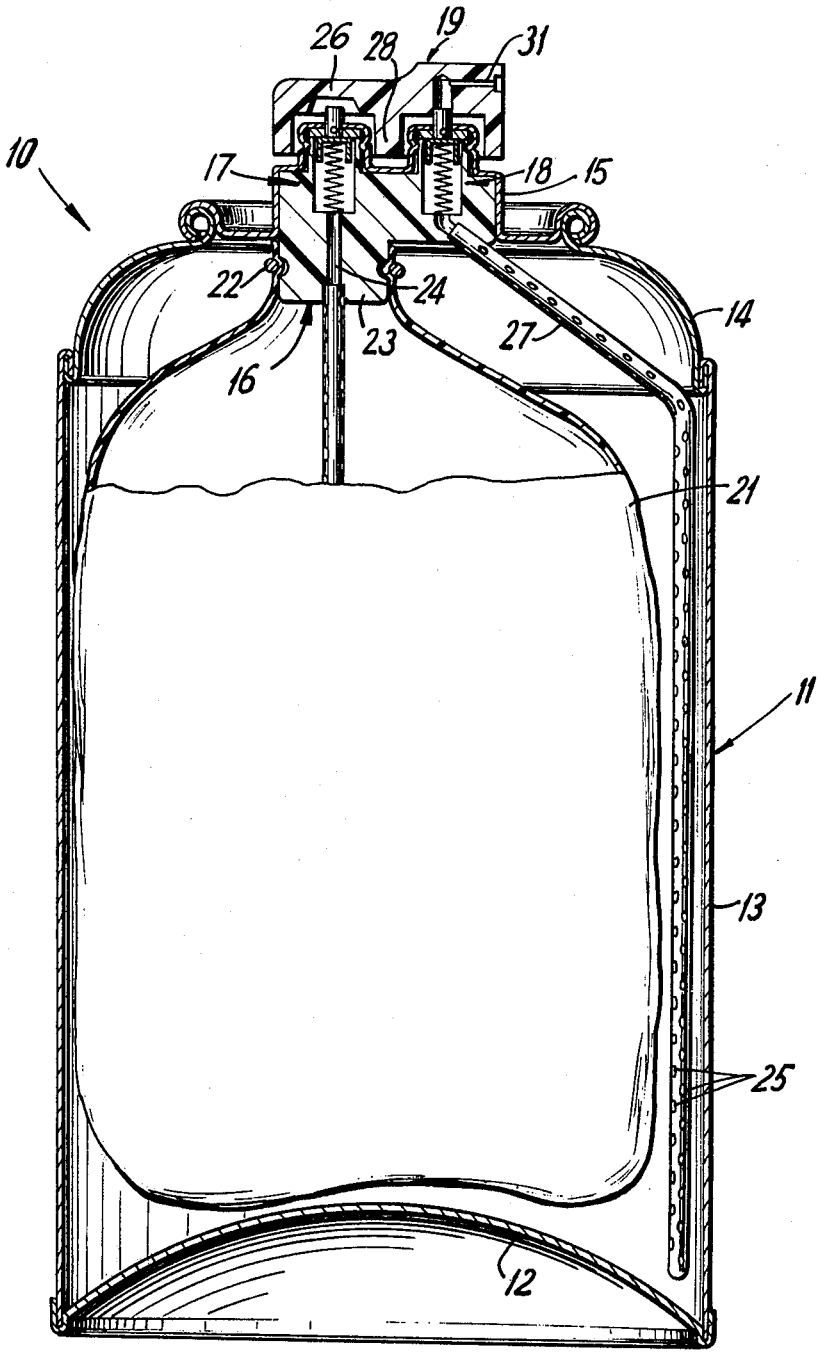
FIG. 1 is a side cross sectional view of one embodiment of the invention.

Referring now to FIG. 1 of the drawings, the invention comprises an aerosol container 10 including an outer container body 11 which is joined into a single unit by rolling or crimping a number of separate sections together. Essentially, the container comprises a base section 12, a cylindrical outer wall 13, a section 14 joined to the upper portion of the cylindrical wall 13, and a top section 15 mounted over the outlet of the container 10. A valve mounting 16 is mounted in the container outlet and fixedly held in place by the top section 15. The mounting includes a pair of conventional valves 17 and 18, one of which 18 is joined to an actuator cap 19.

A flexible propellant bag 21 is fixedly connected to the mounting 16 by conventional means 22 which hold the bag 21 in place about the downwardly extending portion 23 of the mounting 16. The valve 17 is joined to the bag 21 by passage 24 so that the propellant may be loaded into the flexible bag 21 under pressure. The valve cap 19 which is then mounted thereover includes a rear cut away portion 26 which extends over the valve 17 to serve as a protective cover and to prevent contact therewith.

A valve 18 is connected to a perforated product tube 27 which extends downwardly from the valve 18 at an angle and substantially parallel to the cylindrical wall 13 to a distance slightly above the base 12. The valve 18 is essentially of a conventional nature so that the details thereof are well known.

Upon actuation of the cap 19, with the extent of downward movement being limited by the projection 28, the product is forced through the perforations 25 in the tube 27, through the spring-loaded valve 18 and outwardly through the aperture 31 in the cap 19. As the product is emitted from the container 10, the propellant bag 21 expands until it eventually fills or substantially fills the entire container 10. A preferred propellant would be air or an inert gas under pressure which would eliminate the potential for contamination of the atmosphere. This embodiment as well as the other embodiments of the invention described herein also operate whether positioned upside down or right side up.

Figure 3:
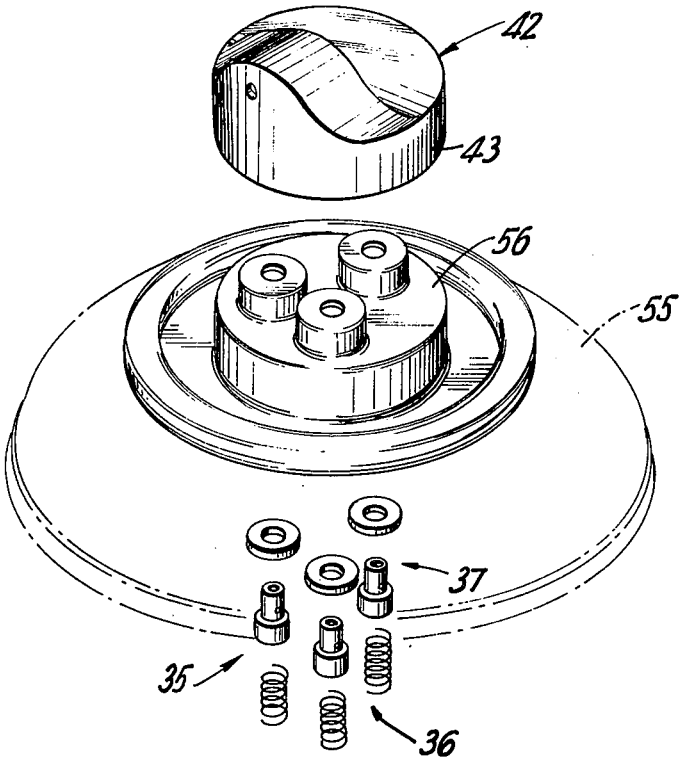
FIG. 3 is a view of the valve arrangement taken along the line 3-3 of FIG. 2, and, FIG. 4 is a front view of the cap mounted on the valve arrangement with portions shown in cross-section.
Figure 3:
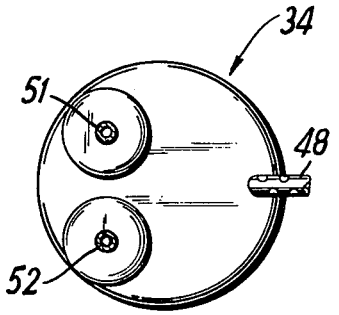
Figure 2:
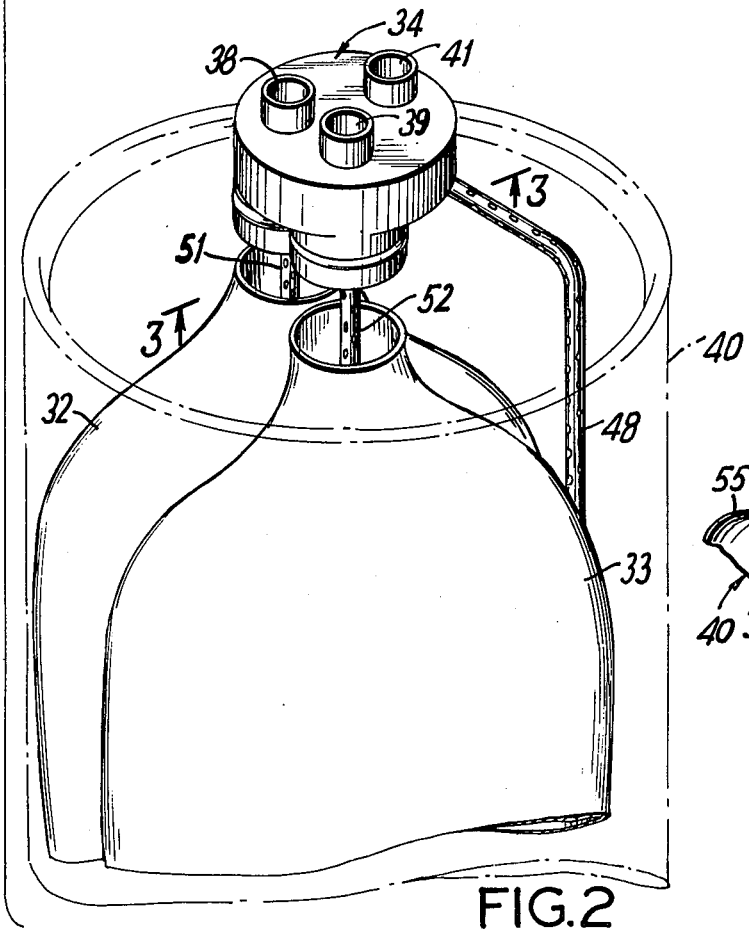
FIG. 2 is an exploded view of the second embodiment of the invention.
Figure 4:
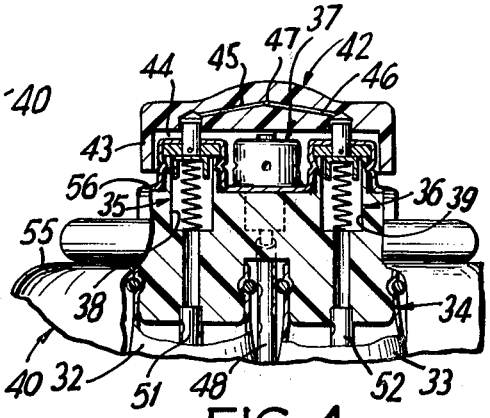

FIGS. 2–4 illustrate a second embodiment of the invention wherein products are contained in one or more product bags 32 and 33 within an aerosol container 40. In this embodiment the pressurized propellant is located on the exterior of the product bags 32 and 33 to force the products outwardly when the mixing cap 42 on container 40 is actuated. The container 40 is more or less shown schematically in these figures but it is similar to the convention container of FIG. 1.

More specifically, the container 40 includes a valve mounting 34 which is sealed at the outlet of the container 40 and includes valves 35, 35 and 37 within tubular openings 38, 39 and 41 respectively. The valves 35 36 and 37 are essentially conventional type arrangements and hence, will not be discussed in detail herein. The exploded view of FIG. 2 shows the major components thereof to a typical spring loaded valve arrangement.

A mixing cap 42 is mounted on the valve stems of valves 35 and 36 in the upper portion 55 of the container 40 with the downwardly extending wall portion 43 forming an internal recess 44. The wall portion 43 contacts shoulder 56 when actuated limiting the movement of the cap 42. Compression of the cap 42 actuates the valves 35 and 36 permitting product from the flexible bags 32 and 33 to flow upwardly through perforated tubes 51 and 52 and then through the passages 45 and 46 to a single outlet passage 47 which serves as a mixing chamber in the mixing cap 42. The particular mixture may be determined by the sizing of the passages 45 and 46 and the relative amounts of products which are loaded into the flexible bags 32 and 33. Thus, it is possible to provide a predetermined spray from a single aerosol container 40 with products which may not be readily mixed in advance, and furthermore, it is possible to retain the propellant within the container 40, also eventual disposal with the container 40. The container 40 may also be used upside down which is an important advantage.

The valve 37 is used merely for loading the propellant into the container 40 by forcing it downwardly within the perforated tube 48. It is also to be noted that this embodiment may be utilized with a single product bag or with more than two product bags as well. The propellant may be compressed air or an inert gas under pressure to lessen the ecological impact of the use of said spray.

While the invention has been explained by a detailed description of certain specific embodiments, it is understood that various modifications and substitutions can be made in any of them within the scope of the appended claims which are intended also to include equivalents of such embodiments.

What is claimed is:

1. An aerosol container comprising:
a sealed container having a valve mounting at one end thereof,
at least one flexible bag located within the container and joined to said valve mounting to receive a pressurized substance therein,
a first valve means located in said valve mounting and having a passage extending downwardly into the flexible bag for filling with propellant and second valve means located in said valve mounting and having a passage extending into the container body to permit loading of a second substance therein,
a perforated dispensing tube coupled to the passage of the second valve means, said tube extending downwardly at an angle from the valve passage to the container wall and then, substantially parallel to the wall of the container, and,
an actuator cap resiliently coupled to the second valve means and having passages therethrough to emit a substance from said valve means and including a cut out portion extending about the first valve means for protection purposes and including a downwardly extending portion to limit the movement of the cap against the container.

2. An aerosol container in accordance with claim 1 wherein:
the flexible bag has a pressurized gas propellant loaded therein and the second substance comprises a predetermined amount of product which is loaded into the container, and,
the valve cap is coupled to the second valve means to emit product therefrom when actuated, as the flexible bag expands.

3. An aerosol container in accordance with claim 2 wherein:
the valve mounting includes a downwardly extending portion having the aperture of the propellant bag mounted thereabout and upper recesses having the first and second valve means located therein.

4. An aerosol container in accordance with claim 1 including:
a pair of flexible bags joined to the valve mounting and having a predetermined amount of product in each bag, and wherein the first valve means comprises a pair of valves each coupled to a separate bag.

5. An aerosol container in accordance with claim 4 wherein:
the second substance comprises a propellant gas loaded into the container under pressure and the valve mounting includes a cap portion positioned over said second valve means to prevent emission of said gas.

6. An aerosol container in accordance with claim 4 further including:
a separate perforated product tube coupled to each valve and extending downwardly into a particular product bag.

7. An aerosol container in accordance with claim 4 wherein:
the actuator cap includes separate passages connected to the outlet of each valve at one end and leading to a single outlet passage, each of such passages being of a predetermined size to attain a desired product from the outlet passage.

8. An aerosol container in accordance with claim 1 including:

a plurality of flexible bags joined to the valve mounting and having a predetermined amount of product in each bag and wherein the first valve means comprises a plurality of separate valves each coupled to a particular bag, and the valve cap includes separate passages connected to the outlet of each valve and an outlet mixing passage to which the passages are connected and wherein the second substance is a pressurized propellant gas.

9. An aerosol container in accordance with claim 4 wherein: the second substance comprises compressed air.

* * * * *